United States Patent [19]

Gilbertson

[11] 4,432,706

[45] Feb. 21, 1984

[54] OIL WELL PUMP DRIVING UNIT

[76] Inventor: Thomas A. Gilbertson, 216 Sandringham, N., Moraga, Calif. 94566

[21] Appl. No.: 390,646

[22] Filed: Jun. 21, 1982

Related U.S. Application Data

[63] Continuation of Ser. No. 148,380, May 9, 1980, abandoned.

[51] Int. Cl.[3] ..... F04B 47/04

[52] U.S. Cl. ..... 417/399; 91/220; 91/248; 91/275; 91/450

[58] Field of Search ..... 417/398, 399, 401, 390; 60/369, 372; 91/220, 248, 275, 450, 459, 469

[56] References Cited

U.S. PATENT DOCUMENTS

| | | | |
|---|---|---|---|
| 2,072,595 | 2/1937 | Hutchinson | 60/372 |
| 2,282,977 | 5/1942 | Mast | 60/372 X |
| 2,665,550 | 1/1954 | Harvey | 60/372 |
| 2,934,899 | 5/1960 | Koplin et al. | 60/369 |
| 3,635,020 | 1/1972 | Mahlmann | 91/449 X |
| 4,136,519 | 1/1979 | Field et al. | 60/369 |
| 4,167,098 | 9/1979 | James | 60/369 |
| 4,191,016 | 3/1980 | Roth et al. | 60/372 X |
| 4,198,820 | 4/1980 | Roth et al. | 60/372 X |

FOREIGN PATENT DOCUMENTS

| | | | |
|---|---|---|---|
| WO80/867 | 5/1980 | PCT Int'l Appl. | 91/275 |
| 1212214 | 11/1970 | United Kingdom | 91/275 |

*Primary Examiner*—Leonard E. Smith

*Attorney, Agent, or Firm*—Flehr, Hohbach, Test, Albritton & Herbert

[57] ABSTRACT

An oil well pump driving unit with a horizontally disposed hydraulic cylinder having a cylinder rod coupled to a drive rope extending into a pumping tee-stuffing box arrangement for driving the sucker rod string leading to a conventional oil well reciprocating pump. The drive rope extends over a first rotating sheave mounted near the wellhead and passes over a second rotating sheave mounted on a carriage which traverses a carriage channel in a draw works on which the hydraulic cylinder is mounted. A hydraulic drive/control system utilizing limit switches on the draw works provides control over the stroke position, the stroke length, and the stroke rate.

6 Claims, 10 Drawing Figures

OIL WELL PUMP DRIVING UNIT

This is a continuation of application Ser. No. 148,380 filed May 9, 1980, now abandoned.

This invention relates generally to oil pump driving units. More specifically, this invention relates to oil pump driving units using a hydraulic cylinder to produce a relatively long, slow pumping stroke.

One of the conventional styles of oil well pump driving units is the walking beam-horse head unit in which the walking beam and horse head are driven in a rocking motion. A cable arrangement running over the horse head is utilized to raise and lower a polished rod which extends through a stuffing box arrangement mounted above the pumping tee on the wellhead casing. The other end of the polished rod is connected to a sucker rod string which extends downhole and is connected on the other end to one of the conventional types of reciprocating pump. This conventional type of pump driving unit comes in various sizes to produce various pump stroke lengths depending on the capacity of the well. For smaller wells, units with a stroke length between about twelve and twenty inches per stroke are used. For larger wells, units with a stroke length between about forty and one hundred seventy inches per stroke may be used. Typically, these types of pumping units are run at fairly high stroke rates of anywhere from about eight to twelve strokes per minute on the smaller units to twelve to thirty strokes per minute on the larger units.

The rapid reciprocating motion of the rod string, including the polished rod and the sucker rod string expanding down the bore hole, produces certain undesirable operating effects. From a mechanical standpoint, this rapid reciprocation produces acceleration, shock and harmonic loading of the rod string with high peak rod loads, all of which shorten the life of the rod string. Moreover, it is well known that the rapid pumping stroke of this type of pump driving unit reduces the volumetric pump efficiency due to the rate at which the pump is attempting to move oil up the tubing string and the agitation and pounding of the fluid in the well.

An additional problem that can be encountered in pumping light oil, i.e., oil which has a substantial volume of dissolved gas, is gas lock of the pump. Gas lock is generally caused by the gas released from the oil in the formation at a rapid rate as the pressure drops in the pump on the upstroke. If the pressure on the head of liquid in the bore hole is not sufficient to compress the gas released into the pump chamber on the upstroke, the pressure of the expanded volume of gas at the top of the pump barrel will not exert sufficient pressure on the travelling valve to counteract the pressure of the fluid column on that valve. Consequently, the valve will not open and no fluid will be moved by the pump. Under this condition, the plunger in the pump merely compresses and expands the gas in the pump barrel. This gas lock problem can make it extremely difficult to pump down some very gaseous wells. Even if a complete gas lock does not occur, the building of gas in the pump barrel reduces substantially the effective oil pumping capacity due to the volume occupied by the gas. Very large capacity wells, in the neighborhood of two hundred barrels per day, justify the use of an expensive cable-type pumping unit, such as the Alpha pump unit manufactured by Bethlehem Steel Corporation, to produce a long, slow pump stroke. The Bethlehem Alpha pumping unit utilizes a pair of spiral cam arrangements mounted on a common shaft, each carrying a cable which is attached either to the sucker rod string through a travelling stuffing box or to a counterweight arrangement which traverses a counterweight well which must be sunk in the ground near the wellhead. The Bethlehem Alpha rig is an expensive pump driving unit which is cost effective only in large capacity wells, but its typical forty foot stroke and three per minute stroke rate produces a long, slow pump stroke cycle which eliminates the above-mentioned problems inherent in the walking beam pumping unit.

While the Bethlehem Alpha type of pumping unit is available for the larger wells, pump driving units for producing a relatively long, slow stroke for smaller wells are not currently available. In some areas, the characteristics of the wells are such that a small walking beam pump unit simply performs so inefficiently in pumping the oil or is subject to intolerably repetitive gas lock conditions that the wells simply are unproductive and remain capped.

Accordingly, it is an object of this invention to provide an improved oil pump driving unit for small capacity oil wells.

It is another object of this invention to provide an improved oil well pump driving unit of the hydraulic drive type.

It is another object of this invention to provide a hydraulic oil well pump driving unit with an improved hydraulic drive/control system.

The pump driving unit of this invention is adapted to be utilized in an oil well pumping apparatus which includes a submerged reciprocating pump mounted in a tubing arrangement communicating with the wellhead, a sucker rod string extending through the tubing arrangement and connected in driving relation with the pump, and a pumping tee and stuffing box arrangement mounted on the casing of the well at the wellhead and including a sealed drive rod arrangement in the stuffing box connected in driving relation to the sucker rod string.

One aspect of this invention features a pump driving unit which comprises the following components: a hydraulic cylinder, including a cylinder rod and an in/out line; means mounting the hydraulic cylinder in an operative position proximate the wellhead; coupling means mounted to the cylinder rod and adapted to couple the cylinder rod in a powered pulling relation to the sealed drive rod arrangement in the stuffing box; and a hydraulic drive/control system for operating the hydraulic cylinder to produce a presettable operating cycle consisting of a hydraulic power upstroke and a gravity power downstroke of presettable length. The hydraulic drive/control system in accordance with the invention includes a hydraulic generator having power and return lines, valve means coupled to the in/out line, the power line and the return line and including a valve element having at least a first position coupling the in/out line to the power line and a second valve position coupling the in/out line to the return line, and control means for producing a presettable operating cycle for the valve means consisting of presettable first and second valve position intervals.

In a preferred embodiment, the control means comprises detecting means responsive to the position of the cylinder rod for signalling when the rod reaches presettable first and second stroke positions, and valve control means responsive to signals from the detecting means to switch the valve element between its first and second positions. In the preferred embodiment, the control means further includes presettable flow restrictor means and a check valve coupled in parallel between the valve means and the in/out line, with the restrictor means controlling the flow rate of fluid out of the cylinder during the downstroke and the check valve bypassing the restrictor means on the upstroke.

Preferably, the valve means utilized in the hydraulic drive/control system is a fluid control valve which includes a valve element and a valve element driving arrangement comprising a pair of solenoids individually actuatable to switch the valve element between first and second positions and a spring means biasing the valve element into a third position when both solenoids are deactuated. In the first valve element position, a connection is established between the power line and the in/out line to drive the cylinder rod during the upstroke. The second valve element position establishes separate connections between the return line and each of the power line and the in/out line during the downstroke. The third valve element position establishes a connection between the power line and the return line and blocks the in/out line. Utilizing this type of fluid control valve, the operating cycle of the hydraulic cylinder may be controlled in a variety of ways. One approach is to utilize first and second switch means and mounting means for mounting each of the switch means in a presettable position determining relation to the cylinder rod to produce an output signal when the cylinder rod reaches first and second stroke positions. A solenoid control means in the form of switching circuit means may be provided to operate in response to the output signals from the first and second switch means, respectively, to actuate an associated one of the solenoids in the valve element driving arrangement and to deactuate the other solenoid to drive the valve element between the first and second positions.

Preferably, with this type of fluid control valve, a release valve is provided between the in/out line and the return line, with the valve maintained in a normally closed position by a third solenoid commonly connected with the first and second switch means and the switching circuit means to an electric power source to produce a downstroke of the cylinder rod upon failure of electric power and consequent deactuation of all of the solenoids.

Another aspect of the invention features a pump driving unit which comprises a rotatably mounted sheave adapted to be positioned proximate the wellhead and to engage a drive rope which is connected in driving relation to the sealed drive in the stuffing box. The sheave changes the vertical drive direction of the drive rope in the stuffing box to a horizontal drive direction. The pump driving unit further includes a hydraulic cylinder including an in/out fluid line and a cylinder rod having a preselected length to provide a preselected maximum stroke length for the driving unit. A structural means mounts the hydraulic cylinder in horizontal orientation with the axis of the cylinder in the plane of the sheave. A coupling means is provided to couple the cylinder rod to the drive rope in a pulling relation and a hydraulic drive/control means is utilized to operate the hydraulic cylinder to produce a presettable operating cycle for the cylinder rod consisting of a hydraulic power upstroke and a gravity power downstroke of length presettable up to the maximum stroke length. Preferably, the structural means comprises an elongated horizontally disposed draw works having a foot end structure adapted to be placed proximate the wellhead and to support the rotatably mounted sheave, a head end structure adapted to mount the hydraulic cylinder and a body structure defining a horizontally disposed carriage channel having a length greater than the maximum operating stroke length of the cylinder. In this embodiment, the coupling means comprises a carriage assembly adapted to transverse the carriage channel, a second sheave rotatably mounted on the carriage assembly in a plane substantially coincident with the plane of the first sheave and adapted to engage the drive rope to reverse the direction of the drive rope by 180 degrees, a rope termination assembly mounted on the draw works for terminating the drive rope at a position proximate the first sheave, and a coupler assembly for coupling the carriage assembly to the cylinder rod. A pump driving unit having the above structural features can utilize a hydraulic drive/control means having any or all of the operating features set forth above.

From the above general description, it should be apparent that the various features of an oil well pump driving unit in accordance with this invention produce a number of advantages over other available types of pump driving units. Probably the principal advantage is that a pump driving unit in accordance with this invention is cost effective for smaller capacity oil wells and produces the same long, slow stroke previously available only in expensive pumping units. Furthermore, the hydraulic drive/control system of this invention has virtually unlimited possibilities for controlling the operating cycle of the pump, including, for example, the stroke rate, the stroke length, and the starting and stopping points of the stroke. Other automatic control features relating to the starting and stopping of the pump cycle are also readily accomplished in the hydraulic drive/control system of this invention. These drive/control system features provide greater pump cycle control than is available on some of the larger, expensive pump units.

The mechanical structure of the pump driving unit produces additional advantages with respect to reliability of operation of a hydraulic type pumping unit. The use of a rotatably mounted sheave positioned proximate the wellhead to change the rope drive direction enables convenient structural mounting of the hydraulic cylinder in a horizontal orientation with its axis in the plane of the sheave. The preferred structural means incorporating the reciprocating carriage assembly coupled to the cylinder rod enables the production of a pump drive stroke which is twice the stroke length of the cylinder rod. Furthermore, the geometry of the draw works structure and the double sheave construction substantially eliminates any side loading on the hydraulic cylinder rod, and thus provides for long operating life of the hydraulic cylinder. The horizontally disposed draw works provides a convenient support for the switch means employed in the hydraulic drive/control means with the switch means actuated by an actuator carried on the carriage assembly or a coupler assembly coupling the carriage assembly to the cylinder rod. In this fashion, precise control over the length and end points of the drive stroke of the pumping unit can readily be achieved.

The operating advantages of a pump driving unit constructed in accordance with this invention over the conventional walking beam-horse head type can readily be seen by direct comparison of the operating efficiency of comparable units. Consider, for example, a walking beam-horse head unit having a stroke length of twenty-four inches and operating at a stroke rate of ten strokes per second, in contrast to a pump driving unit constructed in accordance with this invention and having a 240 inch stroke length and a one per minute stroke rate. With these parameters, the two units are comparable in having a 240 stroke-inch per minute pumping capacity. It is well known, however, that on each stroke of an oil well pump, depending on the length and weight of the column of fluid being moved by the pump, anywhere from four to six inches of the pump stroke is lost to sucker rod stretch and delays in opening of the stationary and travelling valves. Assume for comparison purposes that the stroke distance loss on each cycle is six inches. With this six inch stroke loss, the effective stroke length of the walking beam-horse head unit is only eighteen inches, which reduces the pumping capacity to 180 stroke-inches per minute. In comparison, the loss of six inches in a 240 inch stroke of a unit in accordance with this invention reduces the pumping capacity only to 234 stroke-inches per minute.

In addition to the clear difference in effective pumping capacity of a pump driving unit in accordance with this invention, additional improvements of anywhere from 50 to 300 percent in pumping efficiency may be realized in certain types of wells due to the improved volumetric pumping efficiency achieved with the long, slow stroke of the pumping unit of this invention. The long slow stroke of the pumping unit of this invention substantially reduces the tendency to produce a quick pressure drop in the pump barrel and thus substantially eliminates the loss of pumping efficiency due to boiling dissolved gas out of the oil into the pump barrel. Furthermore, in some types of wells, a pump driving unit in accordance with this invention may enable the effective pumping of oil from wells which would otherwise remain capped because of the inability of the conventional walking beam-horse head unit to effectively move any oil out of the well.

The foregoing, as well as additional objects, features, and advantages of this invention will be apparent from a consideration of the following detailed description taken in conjunction with the accompanying drawings.

Figure 1:
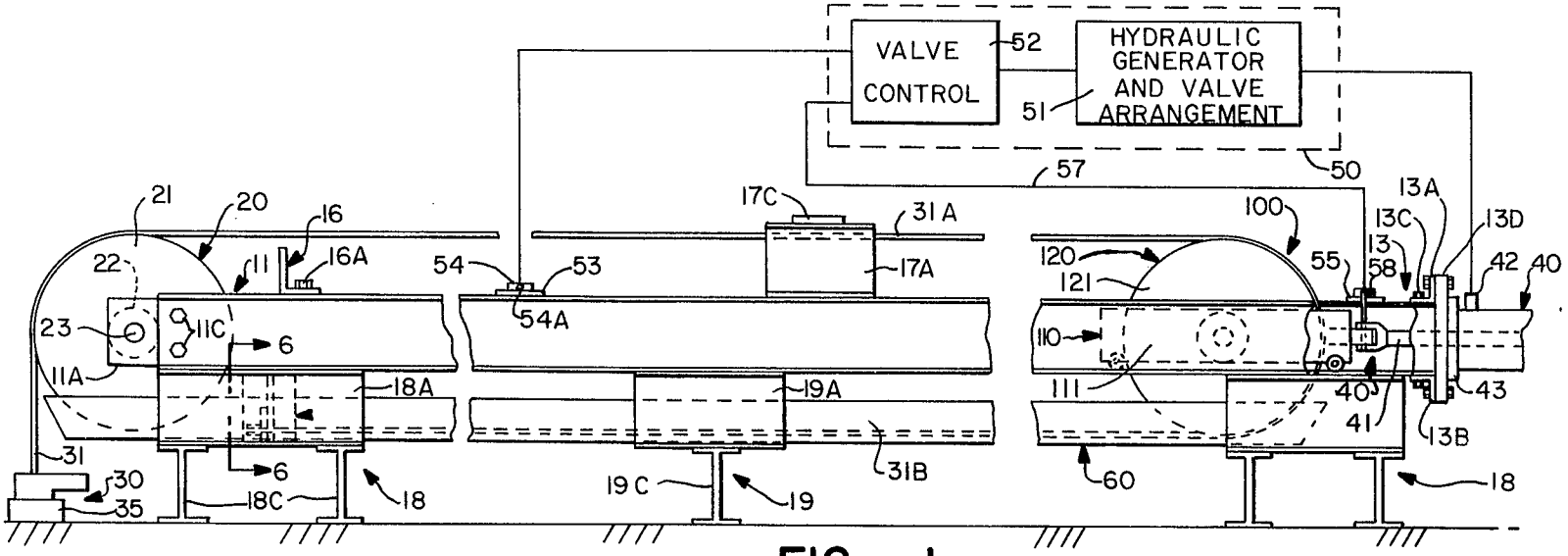
FIG. 1 is an elevational view of an oil well pump driving unit in accordance with this invention.
Figure 2:
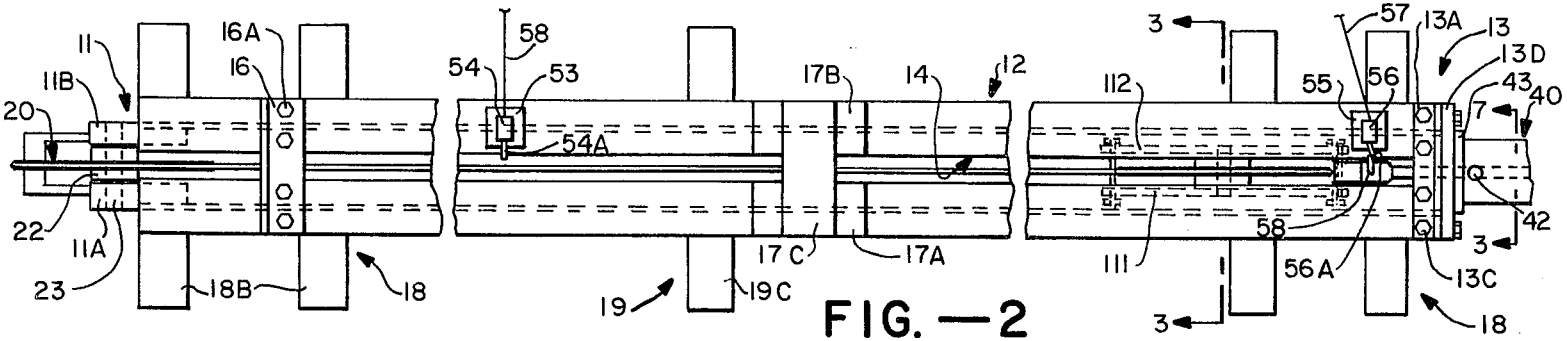
FIG. 2 is a top plan view of an oil well pump driving unit in accordance with this invention.
Figure 8:
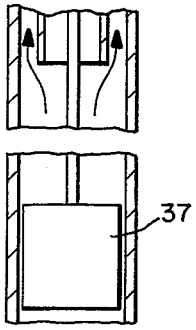
FIG. 8 is a section view showing a pumping tee and stuffing box arrangement useful in connection with this invention.

Referring now to FIGS. 1 and 2, the main structural features of an oil well pump driving unit in accordance with this invention will be described. The main structural features are a structural means 10, a rotatably mounted sheave arrangement 20, a hydraulic cylinder 40, a coupling means 100, and a hydraulic drive/control means 50. The rotatably mounted sheave arrangement 20 is adapted to be positioned proximate the wellhead casing 35, with the sheave 21 engaging the drive rope 31 to change the vertical drive direction of drive rope 31 leaving stuffing box arrangement 30 to a horizontal drive direction. The details of the stuffing box and pumping tee arrangement 30 mounted on wellhead casing 35 are depicted in FIG. 8 and will be described later. Rotatably mounted sheave arrangement 20 basically includes sheave 21 and a hub arrangement 22 for mounting sheave 21 on a shaft 23.

The structural means 10 is essentially a horizontally disposed, dual, I-beam draw works which has a foot end structure generally designated 11, a body section 12, and a head end structure generally designated 13. The foot end structure of draw works 10 is adapted to mount rotatable sheave arrangement 20. The head end structure 13 of draw works 10 is adapted to mount the hydraulic cylinder. The central body structure 12 of draw works 10 defines a horizontally disposed carriage channel 14 having a length greater than the maximum operating stroke length of hydraulic cylinder 40.

The draw works 10 consists essentially of pair of I-beams 15A, 15B disposed in parallel on leg arrangements 18 at the foot and head ends thereof along with a central leg arrangement 19. The structures of leg arrangements 18 and 19 are readily apparent from considering FIGS. 1 and 2 in conjunction with FIGS. 3 and 6. Leg arrangements 18 consist of a pair of spacer I-beam sections 18A and 18B which directly support I-beams 15A and 15B. The flanges of I-beams 18A and 18B may be fastened to the flanges of I-beams 15A and 15B by any convenient means, such as by welding or bolting together the respective beam flanges. A second pair of I-beam sections 18C support the I-beam sections 18A and 18B and extend transversely thereto. The I-beam sections 18C, 18A, and 18B may be fastened together in any convenient means such as by welding or bolting.

Figure 3:
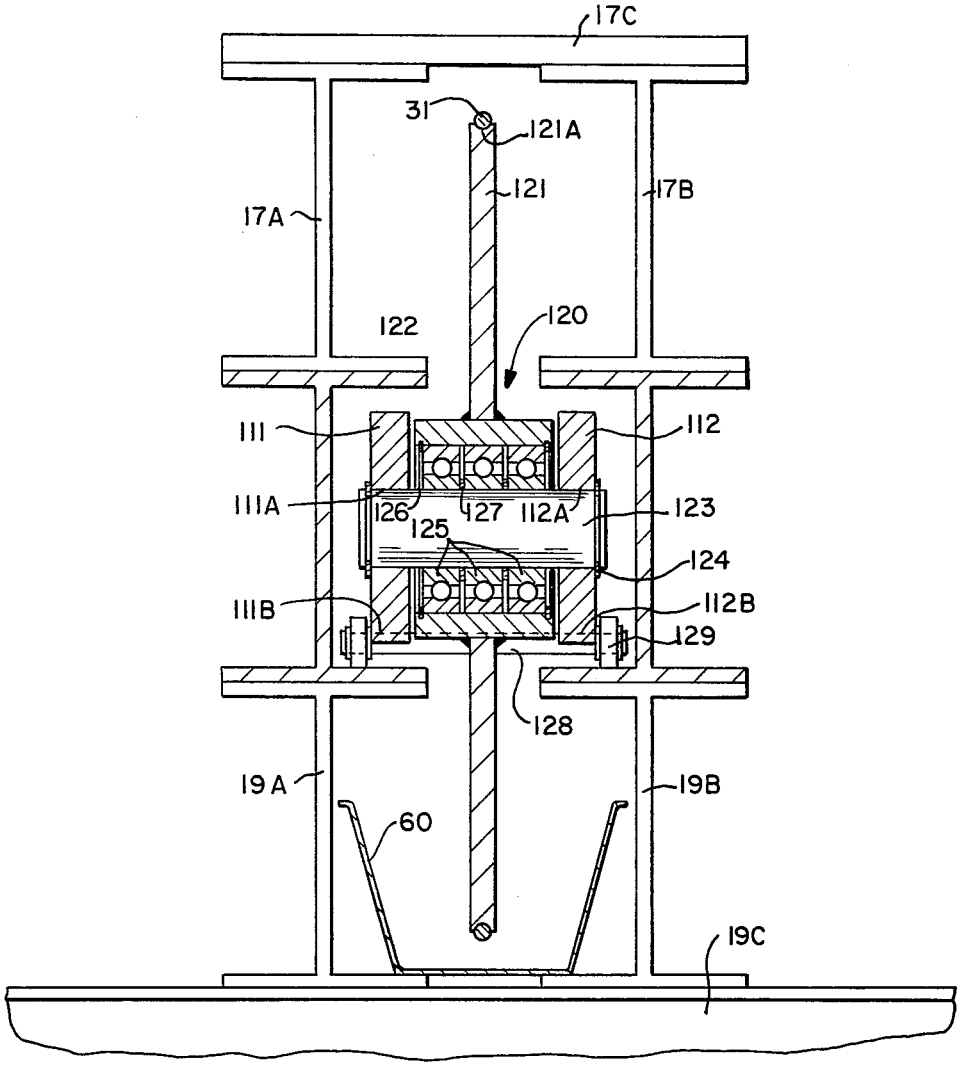
FIG. 3 is a partly sectioned view taken along the lines 3—3 in FIG. 2.
Figure 7:
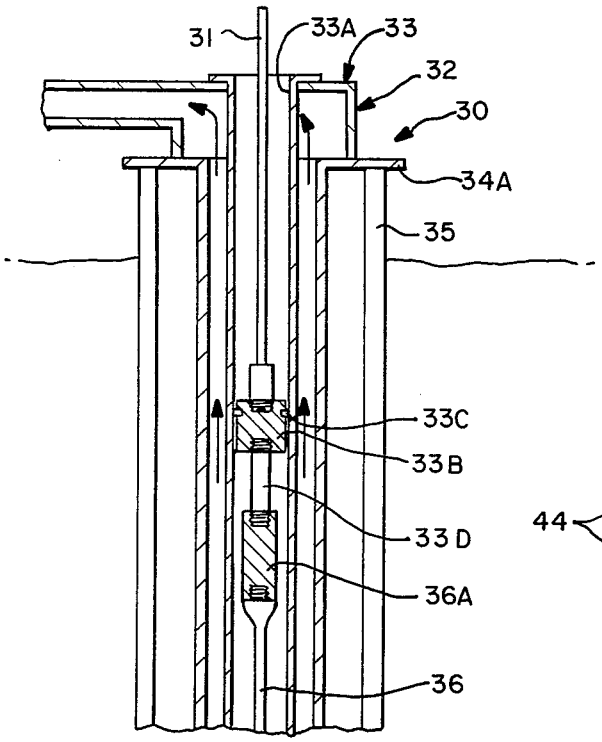
FIG. 7 is a front view of a hydraulic cylinder mounting arrangement taken along the lines 7—7 in FIG. 1.
Figure 7:
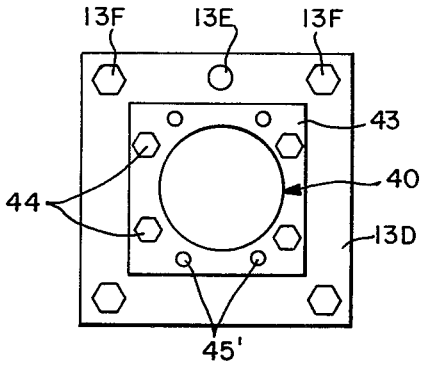

The central leg arrangement 19 depicted in FIG. 3 and FIGS. 1 and 2 consists essentially of a pair of I-beam sections 19A and 19B supporting I-beams 15A and 15B and a transversely mounted I-beam section 19C supporting I-beam sections 19A and 19B. These respective I-beam sections may be fastened together by any convenient means such as welding or bolting arrangements. The leg structures 18 and 19 which support the parallel I-beams 15A and 15B serve to brace the I-beams 15A and 15B at the bottom and to space them a convenient height above the well casing. On the top of I-beams 15A and 15B, other bracing structures are provided. For example, an angle iron brace 16 is provided at foot end section 11 and is fastened to the I-beams 15A and 15B by any convenient fastening means such as the bolts 16A shown in FIGS. 1 and 2. At the central body section 12, a bridge type brace consisting of a pair of I-beam sections 17A and 17B and a top brace 17C are provided. Again, these I-beam sections 17A and 17B and the top brace 17C may be fastened to each other and to the top of I-beams 15A and 15B by any convenient means such as welding or bolting. At head end section 13, a pair of angle iron braces 13A and 13B are provided both for bracing the two I-beams 15A and 15B and to serve as part of the mounting arrangement for the hydraulic cylinder 40, the details of which are shown in FIG. 7. The foot end structure 11 of the draw works 10 includes a pair of mounting blocks 11A and 11B for mounting rotating sheave arrangement 20 on the ends of I-beams 15A and 15B. The mounting blocks 11A and 11B are fastened by means of bolts 11C to the webs of I-beams 15A and 15B, respectively. Mounting blocks 11A and 11B are formed with a shoulder 11D which abuts the end of the web of each I-beam. In this fashion, the mounting blocks 11A and 11B are mechanically tied to the parallel I-beam structure in a way that avoids any buckling force on the I-beams. Each of the mounting blocks 11A and 11B has an aperture through it which accommodates the shaft 23 on which the sheave 21 turns on its hub and bearing assembly 22.

The coupling means 100 which couples the cylinder rod 41 of hydraulic cylinder 40 to the drive rope 31 will now be described in conjunction with FIGS. 1, 2, and 3. The coupling means 100 includes a carriage assembly 110, a rotating sheave arrangement 120, a drive rope termination assembly 130, and a coupler assembly 140. Carriage assembly 110 consists essentially of a pair of carriage blocks 111 and 112 of a length slightly greater than the diameter of the sheave 121. Apertures 111A and 112A in the carriage blocks 111 and 112 receive the shaft 123 on which the sheave 121 and hub 122 rotate. At each end of the underside of each of the carriage blocks 111 and 112 are a pair of semicircular apertures 111B and 112B, which are utilized to mount the carriage blocks 111 and 112 on shafts 128. On each end of the two shafts 128 are rotating bearing wheel arrangements 129 which enable the carriage blocks to roll on the inner flanges of I-beams 15A and 15B.

The rotation sheave arrangement 120 includes sheave 121 which is mounted on hub 122 in any convenient fashion, such as welding. Hub 122 is journaled on shaft 123 by means of a parallel arrangement of ball bearings 125. The ball bearings 125 are spaced from each other by spacer rings 127 and are retained on hub 122 by means of snap rings 126. In this fashion, the hub assembly 122 and sheave 121 are free to rotate on shaft 123. Shaft 123 is retained in the apertures 111A and 112A of the carriage blocks 111 and 112 by means of snap rings 124. The sheave 121 has a circumferential groove 121A machined into the edge to match the profile of the bottom half of the drive rope so that drive rope 31 will be accomodated in groove 121A. The structure of sheave arrangement 20 at the foot end 11 of the draw works 10 is identical to that of the sheave arrangement 120.

Figure 6:
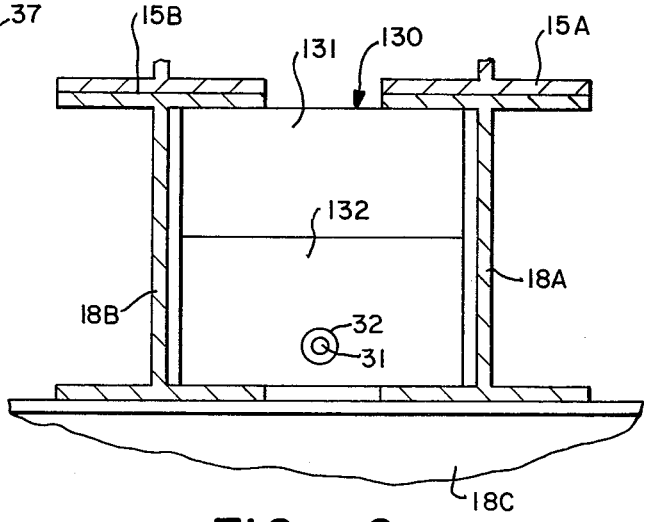
FIG. 6 is a partial section view taken along the line 6—6 in FIG. 1.

FIG. 6 depicts the details of the drive rope termination assembly 130. An I-beam section 131 is mounted between the I-beam sections 18A and 18B which form part of leg structure 18. I-beam section 131 may be fastened to the I-beams 18A and 18B by any convenient means such as welding or bolting. A stress relief block 132 is mounted to the web of I-beam section 131. The drive rope 31 extends through apertures in the web of I-beam section 131 and stress relief block 132. A drum end ferrule 32 is provided on the end of drive rope 31 and effectively captivates the end of the drive rope during the upstroke and downstroke of the pump driving unit during which drive rope 31 is constantly in tension.

Figure 4:
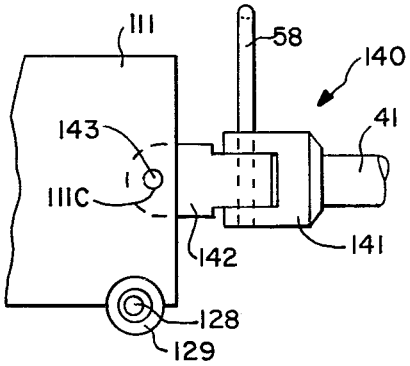
FIGS. 4 and 5 are enlarged side and top views of a coupler arrangement depicted in FIGS. 1 and 2.
Figure 5:
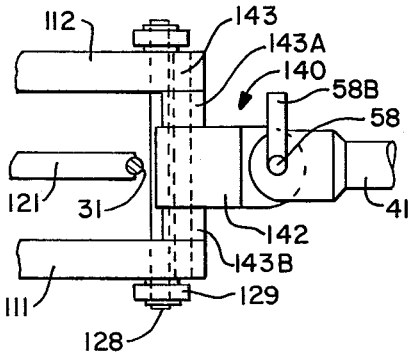

The coupler assembly 140 is shown in enlarged detail in FIGS. 4 and 5. A clevis 141 is provided on the drive end of cylinder rod 41. Typically, clevis 141 is screwed onto cylinder rod 41 using a cooperative screw thread arrangement. Carriage blocks 111 and 112 are coupled to the clevis 141 through a uni-lign coupler 142. A vertical pin 58 fastens coupler 142 to clevis 141 and a horizontal pin 143 extends through apertures in carriage blocks 111 and 112 and spacer blocks 143A and 143B to mount uni-lign coupling 142 to the carriage assembly 110. This mounting arrangement assists in compensating for any slight misalignment that may occur between the axis of cylinder rod 41 and the plane of sheave 121.

The overall geometry of the draw works 10 and the mounting arrangements for rotating sheave assembly 20 and the carriage assembly 110 and rotating sheave assembly 120 and hydraulic cylinder 40 is such that the axis of cylinder rod 41 is substantially aligned with the axes of rotation of sheaves 121 and 21 and also passes through the central plane of sheaves 121 and 21. This geometry together with the coupling arrangement 140 substantially eliminates any side loading on the cylinder rod 41 and minimizes any buckling stress on the I-beams 15A and 15B. With proper alignment, the carriage assembly 110 is only required to carry its own weight on the rotating wheel arrangement 129. The location of the termination point of drive rope 31 in termination assembly 130 is carefully arranged to maintain cable section 31A substantially parallel to cable section 31B. This eliminates any vertical loading of the carriage assembly 110 or the cylinder rod 41 by the tension in the cable on the upstroke or the downstroke. For long operating life of the cable drive, which is preferably a steel wire rope, an oil pan 60 is provided under the draw works to keep drive cable 31 constantly lubricated with oil. Cable life is also extended by using a sheave diameter which is about forty times the diameter of the wire rope. This large ratio of sheave diameter to rope diameter avoids bending stresses in the cable, especially as it passes over sheave 121. Cable life is also optimized by precision machining of the circumferential groove in the sheave and by using a cable with a breaking force rating at least about four times the anticipated tension to be placed on the rope during the upstroke of the driving unit.

The cylinder mounting arrangement for fastening hydraulic cylinder 40 to the head end structure 13 of the draw works 10 will be described in conjunction with FIGS. 1, 2, and 7. The L-shaped angle iron brackets 13A and 13B extend transversely across the I-beams 15A and 15B and are secured thereto by means of the bolts 13C. The vertical flanges on the brackets 13A and 13B provide a mounting surface for cylinder mounting plate 13D. A register pin 13E extends through mounting plate 13D and angle bracket 13A to support the weight of mounting plate 13D and to provide proper registration of the mounting plate 13D on the angle brackets 13A and 13B. A central aperture (not shown) extends through mounting plate 13D to accommodate the cylinder rod 41. Mounting bolts 13F secure mounting plate 13D to the angle brackets 13A and 13B. The register pin 13E carries all the weight of the mounting plate 13D so that no shear forces exist on the threads of bolts 13F.

Figure 9:
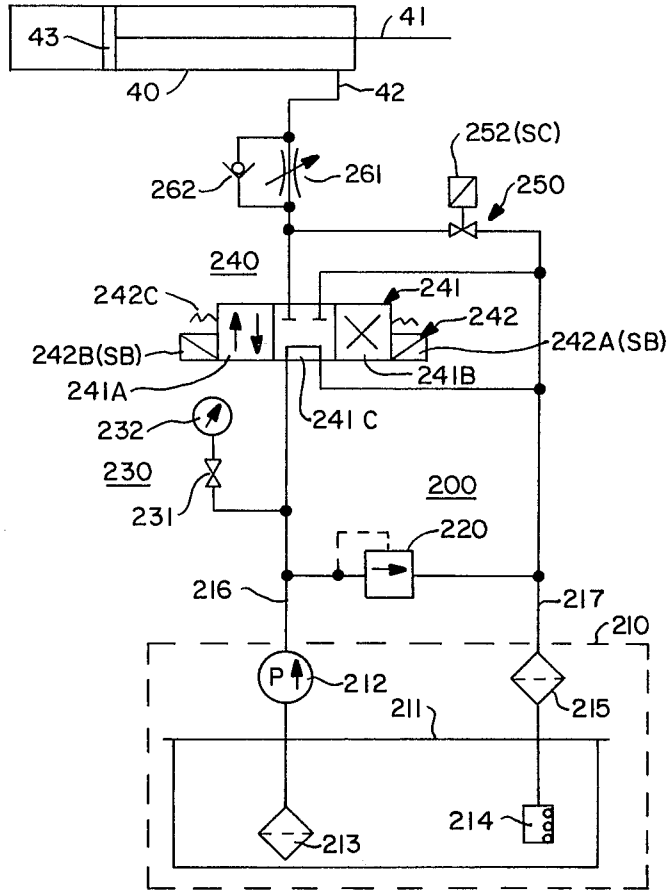
FIGS. 9 and 10 are hydraulic and electrical circuit schematics, respectively, depicting the features of a hydraulic drive/control system in accordance with this invention.
Figure 10:
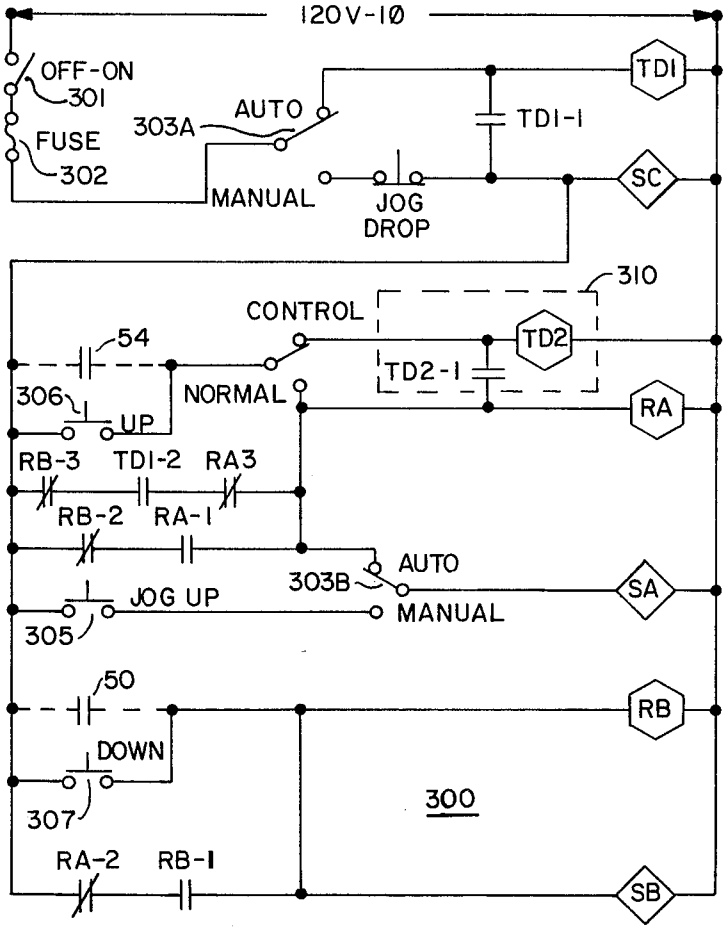

The mounting flange 43 of hydraulic cylinder 40 is bolted to the mounting plate 13D by means of bolts 44. A plurality of register pins 45 extend through mounting flange 43 into machined apertures in mounting plate 13D in order to provide proper registration of the mounting flange 43 on the mounting plate 13D. The register pins 45 carry the weight of hydraulic cylinder 40 so that no shear forces are produced on the threads of mounting bolts 44. This mounting arrangement provides for a careful alignment of the axis of hydraulic cylinder 40 with the axis of the carriage 110 and sheave assembly 120. A small degree of alignment adjustment is provided by using the single register pin 13E in mounting block 13D. FIGS. 1 and 2 depict schematically the hydraulic drive/control system for operating the hydraulic cylinder 40 in accordance with this invention. The details of an exemplary version of the hydraulic drive/control system 50 are depicted in FIGS. 9 and 10. Generally, the hydraulic drive/control system 50 includes a hydraulic generator and valve arrangement 51 which communicates with the in/out line 42 of hydraulic cylinder 40. Hydraulic generator and valve arrangement 51 are controlled by a valve control arrangement 52 which communicates with a pair of limit switches 54 and 56 through signal lines 57 and 58. Limit switches 54 and 56 are mountable on the top flange of I-beam 15B at presettable locations by way of magnetic mounting blocks 53 and 55. The switch arms 54A and 56A on limit switches 54 and 56 extend substantially to the internal edge of the flange on I-beam 15B so that the actuator arm 58B on pin 58 will trigger each limit switch as it arrives at the limit switch position. The basic function then of the hydraulic drive/control sytem is to cause the hydraulic cylinder to drive the carriage assembly 110 between the two presettable positions of limit switches 54 and 56. The details of an exemplary such hydraulic drive/control system will be set forth in connection with FIGS. 9 and 10.

FIG. 8 depicts an exemplary version of a pumping tee and stuffing box arrangement 30 which may be utilized in connection with this invention at the wellhead 35. Wellhead casing 35 supports a tubing arrangement 34 by means of a tubing hanger 34A. Tubing 34 extends down the bore hole, usually from several hundred to several thousand feet, to where the reciprocating pump arrangement 37 is located in the pool of oil to be pumped. A pumping tee 32 is provided above the tubing hanger 34 for conducting the oil pumped to the surface to a piping system (not shown) which leads either to a storage tank or into a pipeline to a remote location. A sucker rod string 36 extends through the center of the tubing 34 and is connected at the bottom of the bore hole to the reciprocating pump 37. The stuffing box 33 is mounted on pumping tee 32 in any convenient fashion. Typically, the stuffing box will be either screwed into the pumping tee 32 or clamped onto the pumping tee in a sealed arrangement.

Stuffing box 33 essentially consists of a tubular section 33A which extends down into the bore hole and has a polished interior surface. A piston 33B is mounted inside the tubing 33A for traversing the length of the tubing. Sealing rings generally designated 33C are provided to preclude the passage of oil past the piston 33B. A coupling rod 33D is threaded into piston 33B at one end and into a rod box 36A at the other end. Rod box 36A couples the coupling rod 33D to the sucker rod string 36. Drive rope 31 is connected into piston 33B by means of a ferrule end coupling 31A which screws into the top of piston 33B. The length of tubing 33A is slightly larger than the stroke of the pump. In other words, the piston 33B traverses tubing 33A as the pump driving unit depicted in FIG. 1 alternately produces a hydraulically powered upstroke and a gravity power downstroke produced by the weight of the sucker rod string and the plunger of the pump 37. On the upstroke of the sucker rod string, the oil is pulled by the pump 37 up the bore hole and passes through the channel between the stuffing box tubing 33A and the well tubing 34 into pumping tee 32.

The operation of the pump driving unit of this invention should now be apparent from a consideration of the structures depicted in FIGS. 1 and 2 and 8 of the drawings. With the carriage assembly 110 in the position shown in FIG. 1, the pumping unit is at the top of the upstroke. In this position, the limit switch 56 has just been triggered by the actuator 58B which causes a removal of the hydraulic power to cylinder 40. At this point, the weight of the pump barrel and sucker rod string extending down the bore hole will begin to pull carriage 110 toward the wellhead, forcing the hydraulic fluid out of cylinder 40. This is permitted by the hydraulic valve arrangement when it receives the signal from limit switch 57 through the valve control arrangement 52. Carriage 110 with rotating sheave arrangement 120 thereon will slowly travel toward the wellhead, permitting the piston 33B in the stuffing box 33 to drop and permitting the pump barrel in pump 37 to drop toward the stationary valve in the pump. As the pump plunger drops, the travelling valve in the pump opens and permits passage of oil into the volume above the plunger. The piston 33B, sucker rod string 36, and pump plunger in pump 37 continue to drop as carriage 111 moves toward the position of limit switch 54. When actuator 58B actuates limit switch 54, a signal is sent to valve control arrangement 52 which in turn signals the hydraulic generator and valve arrangement 51 to begin to supply hydraulic fluid to cylinder 40 again. This is the end of the downstroke and the beginning of the power upstroke of the pumping unit. Hydraulic power is then supplied to the carriage 110 by the cylinder rod 41 pulling it away from the wellhead until the limit switch 56 is again triggered to reverse the cycle. It will be appreciated that as carriage 110 traverses the carriage channel 14 between the I-beams 15A and 15B, the length of the drive rope 31 carried on the draw works 10 changes by a distance twice the travel of the carriage assembly 110. Consequently, the stroke of the pump 37 down the bore hole is twice the stroke of the cylinder rod 41. In an exemplary apparatus according to the invention, the cylinder rod 41 may have a driving stroke of twelve feet to produce a pump driving stroke of twenty-four feet. It will be appreciated, however, that the driving stroke of the hydraulic cylinder and the pump driving stroke may be any desired length.

FIGS. 9 and 10 together depict an exemplary hydraulic drive/control system for hydraulic cylinder 40 in accordance with this invention. Referring first to FIG. 9, an exemplary hydraulic generator and valve arrangement 200 will be discussed. The main components of the hydraulic generator and valve arrangement 200 are a hydraulic generator arrangement 210 and a fluid control valve 240 which controls the connections between the in/out line 42 of hydraulic cylinder 40 and the power and return lines 216, 217 from hydraulic generator 210. Hydraulic generator 210 includes a hydraulic fluid reservoir 211 and a pump 212 which withdraws fluid from reservoir 211 and supplies it under pressure to power line 216. A strainer 213 is provided in fluid reservoir 211 and another strainer 215 is provided in the return line 217 to keep the hydraulic fluid clean. A fluid diffuser 214 is provided in reservoir 211 to prevent agitation of the hydraulic fluid returning to the reservoir. A pilot operated relief valve 220 is provided between the power line 216 and the return line 217 to operate as a safety valve in the event that a jamming or other malfunction of the pump driving unit occurs and the pressure builds up too high in the drive line 216. Generally, the operating pressure of the pilot operated relief valve will be set three or four hundred pounds over the maximum pressure required to operate the hydraulic cylinder.

A monitoring gauge arrangement 230, including a valve 231 and a pressure gauge 232, is coupled to the power line 216 to permit monitoring of the pressure in the power line. By monitoring the pressure in the power line 216, it is possible to determine how much force is required to lift the rod string and gain some idea how much fluid is being pumped from the well. It is also possible to determine if there is some problem in the well, such as the rubbing of the rod string on the side of the tubing or other jamming or mechanical restriction in the well.

Fluid control valve 240 is a four port, three position valve. One of the four ports is coupled to the power line 216, two of the ports are coupled to the return line 217 and the fourth port is coupled to the in/out line 42. The valve spool or valve element 241 has three positions designated 241A, 241B and 241C. When valve spool 241 is in position 241A, power line 216 is coupled to in/out line 42 and hydraulic fluid under pressure is coupled into hydraulic cylinder 40 to drive piston 43 and cylinder rod 41. A check valve 262 and a presettable flow restrictor 261 are connected in parallel between the fluid control valve and the in/out line 42. During the power upstroke of hydraulic cylinder 41, the check valve 262 opens to bypass the restrictor 261 so that full hydraulic power is applied to the cylinder 40.

When valve spool 241 is in position 241B, the power line 215 is directly coupled to return line 217 and in/out line 42 is directly coupled to return line 217. In this valve spool position, the hydraulic fluid from cylinder 40 is allowed to return to reservoir 211 through flow restrictor 261, check valve 262 being closed during this cycle. By varying the setting of flow restrictor 261, the velocity of the gravity powered downstroke can be selected and, in this manner, the stroke rate of the pump driving unit may be controlled. The velocity of the upstroke may be varied by varying the speed of the motor driving the hydraulic pump 212 or by using a variable rate pump.

When valve spool 241 is in position 241C, power line 216 is coupled directly to return line 217 and in/out line 42 is blocked. Position 241C of valve spool 241 is established by the biasing spring 242C when neither of the solensoids 242A and 242 are actuated. When solenoid 242A is actuated with solenoid 242B deactuated, valve spool 241 is in position 241A. When solenoid 242B is actuated with solenoid 242A deactuated, valve spool 241 is in position 241B.

A solenoid operated valve arrangement 250 is connected between in/out line 42 and return line 217 to provide for a downstroke of cylinder rod 41 when valve spool 241 is in position 241C due to a power failure or malfunction on the valve control arrangement depicted in FIG. 10. Normally, solenoid 252 is actuated to keep valve 251 closed. However, upon failure of power to solenoids 240A, 242B, and 252, valve 251 is permitted to open and hydraulic fluid will be returned from cylinder 40 through in/out line 42, restrictor 261, valve 251, and return line 217.

FIG. 10 illustrates an exemplary valve control arrangement for controlling the operation of the fluid control valve 240 in FIG. 9 and the downstroke relief valve arrangement 250 in FIG. 9. Solenoid SC in FIG. 10 corresponds to solenoid 252 in FIG. 9. Solenoids SA and SB in FIG. 10 correspond with solenoids 242A and 242B in FIG. 9. Switch contacts 54 and 56 in FIG. 10 correspond to limit switches 54 and 56 in FIGS. 1 and 2.

The control arrangement 300 operates off a 120 volt supply and includes an on/off switch 301 and a fuse arrangement 32. A selector switch arrangement 303 having two sections 30A and 303B is utilized to switch the control arrangement between AUTO and MANUAL mode. A second switch arrangement 308 is utilized to switch the control arrangement between a NORMAL operating cycle and a CONTROL operating cycle. The function of these switching modes will be apparent from a later description of the overall circuit operation in each mode. In the NORMAL mode setting of switch 308, limit switch contacts 54 are directly in series with the winding of relay RA. Limit switch contacts 56 are directly in series with the winding of relay RB with no itervening selector switch. Assuming selector switch arrangement 303 is in the AUTO position, the winding of solenoid SA is in series with a pair of make contacts RA-1 on relay RA and break contacts RB-2 on relay RB. Similarly, the winding of solenoid SB is in series with a pair of make contacts RB-1 associated with relay RB and a pair of break contacts RA-2 associated with relay RA. The contact set RB-2 and RA-1 are in parallel with limit switch make contact 54 and also in parallel with a manually actuable UP switch 306. Similarly, contacts RA-2 and RB-1 are in parallel with the make contacts of limit switch 56 and also in parallel with a DOWN switch 307. In parallel with the contacts RB-2 and RA-1 is a series connection of break contacts RB-3 associated with relay RB, make contacts TD1-2 associated with relay TD1, and break contacts RA-3 associated with relay RA. This contact string functions to start the pump driving unit after a power failure under certain conditions, as will be later described.

When selector switch 303 is in the AUTO position, application of power to all of the switches, solenoids, and relays in the valve control arrangement is provided through make contacts TD1-1 on a time delay relay TD1. The function of the time delay relay will be discussed later. When selector switch 308 is in the control position, a control circuit 310 controls the application of electric power to relay winding RA. One version of a control circuit involving a second time delay relay TD2 and a pair of make contacts TD2-1 is shown in FIG. 10. In this mode, the time delay relay TD2 will delay the application of power to operate relay winding RA when limit switch contacts 54 close at the end of the downstroke of the pump driving unit. The purpose of this mode will be described later.

Consider now the NORMAL function mode of the valve control arrangement of FIG. 10. For purposes of discussion, assume that the carriage assembly 110 in FIG. 1 is in the position shown with the actuator 58B on the coupler assembly 140 having just actuated limit switch 56. In other words, the pump driving unit has reached the limit of its presettable upstroke. Prior to arriving at this position during the upstroke, relay RA has been actuated and relay RB is deactuated. Relay RA is held actuated by the break contacts RB-2 of deactuated relay RB and the make contacts RA-1 of actuated relay RA. When limit switch contacts 56 close, power is applied to the winding of relay RB and to the winding of solenoid SB. Relay RB and solenoid SB operate together to switch the pump driving unit to the gravity powered downstroke portion of the stroke cycle. With the operation of relay RB, contacts RB-1 make and contacts RB-2 break. With the breaking of contacts RB-2, power is removed from solenoid SA and the winding of relay RA. Consequently, both are deactuated. With the deactuation of solenoid SA, the actuation of solenoid SB becomes effective to switch the valve spool 241 to its position 241B. With the deactuation of relay RA and the actuation of relay RB, contacts RA-2 and RB-1 are closed to provide continuing electric power to relay RB and solenoid SB. With valve spool 241 in position 241B, the weight of the rod string pulling on cylinder 41 forces hydraulic fluid out of cylinder 40, and the carriage assembly 110 coupled to cylinder rod 41 begins to move toward the wellhead. Although limit switch contacts 56 break as the carriage 110 moves toward the wellhead, the contacts RA-2 and RB-1 maintain power to relay RB and solenoid SB. This operating state continues until the carriage reaches a position near the wellhead whereat limit switch 54 is triggered.

When limit switch 54 is triggered, power is applied both to relay RA and solenoid SA through limit switch contacts 54. Actuation of relay RA causes the breaking of contacts RA-2 which disconnects relay RB and solenoid SB from the power source. As relay RB deactuates and relay RA actuates, a closed electrical path is provided through contacts RB-2 and RA-1 to both relay RA and solenoid SA. Consequently, valve spool 241 is returned to position 241A whereat hydraulic fluid power is again provided to the cylinder 40 and the upstroke of the pump driving unit begins. After the contacts on limit switch 54 have been broken, the power to relay RA and solenoid SA is maintained through the contacts RB-2 and RA-1. The upstroke of the pumping unit continues until the limit switch 56 is again actuated to reverse operation of the solenoids SA and SB to reposition the valve spool 241 to position 241B.

Normally open contacts switches 306 and 307 can be utilized to manually control the upstroke and downstroke cycle of the pump driving unit. Closing switch 306 is equivalent to the contacts on limit switch 54 making, and closing of switch 307 is equivalent to the contacts on limit switch 56 making. Consequently, it should be apparent that the UP switch 306 and the DOWN switch 307 can manually control the upstroke and downstroke cycling of the pump driving unit.

Consider now the operation of the valve control arrangement 300 when selector switch 308 is in the CONTROL position. In this position the closing of limit switch contacts 54 does not immediately apply electric power to relay RA and solenoid SA. Instead, electric power is initially applied only to the winding of time delay relay TD2 which has a settable operating delay built into the relay. Accordingly, a selected delay period later contacts TD2-1 make to apply power to relay RA and solenoid SA. Thus, in the CONTROL mode of switch 308, the start of the upstroke of the pump driving unit is delayed by the settable delay interval of time delay relay TD2. Other control circuit arrangements could be provided for control circuitry 10; for example, a circuit could be provided which counts a certain number of cycles of the pump driving unit and then shuts off the operation of the unit for a selectable period of time. Another control function that could be implemented here is the use of a fluid level transducer and sending arrangement down the bore hole to sense when fluid has reached a certain level in the well to be pumped out, whereupon a signal would be sent to a receiving unit in control circuit 310 to cause the pump driving unit to begin to cycle. The pump driving unit would then cycle normally until the level fell below the level of the fluid level detector, whereupon the pump driving unit would pause at the end of the next downstroke until the fluid level built up to the position of the fluid level sensor. Numerous other types of control circuits could be provided in the valve control arrangement to control the cycling of the pump driving unit.

Consider now the response of the valve control arrangement to a power failure or a blowing of the fuse 302. Solenoid SC is maintained in an actuated condition by the electric power supplied through contacts TD1-1 of time delay relay TD1. When electric power is lost to the valve control arrangement 300, solenoid SC deactuates as do all of the other relays and solenoids in the valve control arrangement 300. The deactuation of solenoid SC causes valve 251 in FIG. 9 to open. With the opening of valve 251, a downstroke of cylinder 40 is produced as the fluid in cylinder 40 travels through in/out line 42 and valve 251 to return line 217. If the power interruption is short, time delay relay TD1 will delay the reapplication of power to solenoid SC to permit a completion of the downstroke of cylinder rod 41. This time delay also permits the other electrical components of the system including pump 212 if it is electrically driven to come back up to full operating capacity before attempting to operate the pump driving unit. Once the time delay interval of time delay relay TD1 has ended, contacts TD1-1 make, causing the actuation of solenoid SC so that the hydraulic drive/control system can begin to function again in its selected mode. If limit switch 54 has been positioned to start the upstroke at a position advanced from the maximum stroke of cylinder rod 41, the contact series RB-3, TD1-2, RA-3 operate to start the drive/control system. With relays RA and RB deactuated, contacts RB-3 and RA-3 are closed so that, when contacts TD1-2 make, a power is applied to relay RA and to solenoid SA to start the operating cycle. Thereafter, this contact series does not affect the operation of the hydraulic drive/control system because one of the contacts RB-3 and RA-3 is always open.

Consider now the operation of the valve control arrangement 300 and the MANUAL setting of switch 303. The MANUAL setting of switch 303 places a normally closed JOG DROP switch in series with solenoid SC and with the remaining circuitry of valve control arrangement 200. Consequently, when JOG DROP switch is opened, electric power is interrupted and solenoid SC is deactuated. This permits a dropping of the pump driving unit as the solenoid valve 251 opens due to the deactuation of solenoid SC. Similarly, the JOG UP switch can be actuated to apply power to solenoid SA, causing valve spool 241 to be placed in position 241A causing a power upstroke for the cylinder 40. In the MANUAL mode, the limit switches 54, 56 and the relays RA, RD associated therewith are removed from the circuit, and control of the operating cycle of the pump driving unit is completely under the control of the JOG DROP switch 304 and the JOG UP switch 305.

Having described an exemplary embodiment of the mechanical/structural features of a pump driving unit as depicted in FIGS. 1 and 2 and an exemplary embodiment of a hydraulic drive/control system in accordance with this invention, it should be apparent that numerous modifications could be made therein without departing from the principles of this invention. For example, instead of utilizing the elongated parallel I-beam draw works 10 illustrated in FIGS. 1 and 2, a steel cage structure or any other type of draw works structure could be employed. Furthermore, in a simplified version of the invention, instead of employing a second rotating sheave arrangement 120 on carriage assembly 110 to be coupled to the cylinder rod 41 of cylinder 40, the draw works 10 could be constructed such that cylinder 40 is mounted on the draw works with the axis of cylinder rod 41 directly in line with the drive rope passing over rotating sheave arrangement 20 such that drive rope 31 is directly coupled to the cylinder rod 41. Numerous other coupling arrangements could be substituted for the coupling arrangement 100 illustrated in FIG. 1. Some of these coupling arrangements could involve a tandem serial coupling of draw works 10 with the second draw works half the length of the first and the cylinder being half the stroke of the cylinder shown in FIG. 1. Also, parallel combinations of the draw works 10 and the coupling assembly 100 could be utilized in conjunction with an intervening idler wheel to produce a pump driving unit stroke of a length four times the stroke length of the hydraulic cylinder.

Referring to the hydraulic drive/control system, it should be apparent that numerous alternative approaches could be taken to achieve the same drive/control features of the system depicted in FIGS. 9 and 10. For example, instead of using a four port, three position valve driven by a positioning arrangement of two solenoids and a spring biasing means, an arrangement of separate control valves individually operated by solenoids could be provided to achieve the same valve control function. Referring to the valve control arrangement depicted in FIG. 10, it should be apparent that numerous alternative schemes could be employed to achieve substantially the same control features. For example, while mechanically actuated limit switches are disclosed, it should be apparent that numerous other types of limit switch arrangements could be utilized such as capacitive or magnetic proximity switches, photoelectric switches, etc. The various types of limit switches could be provided with a variety of mounting arrangements for presetting the location of the limit switches on the draw works 10.

The essential function provided by the valve control arrangement depicted in FIGS. 1 and 10 is to provide presettable first and second valve position intervals associated with the first and second valve positions of the valve spool 241 in FIG. 9, i.e., positions designated 241A and 241B. In the exemplary approach depicted and described above, the first and second valve position intervals are established by the relative time intervals between actuation of the respective limit switches 54 and 56. In other words, the first valve position interval relates to the hydraulic power upstroke of the pump driving unit and consists of the time interval required for the hydraulic cylinder to drive the carriage assembly 110 between the presettable position of limit switch 54 and the presettable position of limit switch 56. Correspondingly, the second valve position interval is the time period required for the carriage assembly 110 to be pulled by the rod string from the presettable position of limit switch 56 back to the presettable position of limit switch 54. It should be appreciated that this is only one of several possible approaches to establishing presettable first and second valve position intervals. For example, a single limit switch such as switch 54 could be utilized to preset the starting position of the upstroke and the end position of the downstroke of the pump driving unit. Then, instead of using a second limit switch to terminate the upstroke and begin the downstroke, a presettable timer arrangement could be utilized to control the duration of the power upstrokes such that when the timer expired, the gravity powered downstroke would begin. Accordingly, the duration of the power upstroke interval, i.e., the first valve position interval, would control the power upstroke length. The second valve position interval would be controlled by the setting of the restrictor 261 (FIG. 9).

Furthermore, it should be appreciated that a pair of settable timer arrangements could be utilized instead of limit switches to separately control the duration of the hydraulic power upstroke and the gravity power downstroke of the pumping unit, with appropriate correlation between the two presettable time intervals such that the upstroke and downstroke lengths are equal to each other. Any of these alternative approaches for establishing presettable first and second valve position intervals could readily be implemented by persons of ordinary skill in this art using either electromechanical or solid state timing and switching circuits.

Referring specifically to the relay switching circuit arrangement depicted in FIG. 10, it should be apparent that the electromechanical switching and logic arrangement depicted could readily be replaced by a solid state digital logic and switching arrangement for controlling the operation of solenoids SA and SB.

It should thus be apparent that those skilled in this art could provide numerous alternative approaches to implementing the principles of this invention as set forth in the following claims.

What is claimed is:

1. In an oil well pumping apparatus which inclues a submerged reciprocating pump mounted in a tubing arrangement communicating with the wellhead, a sucker rod string extending through said tubing arrangement and connected in driving relation with said pump, and a pumping tee and stuffing box arrangement mounted on the casing of the well at the wellhead and including a sealed drive rod arrangement in the stuffing box connected in driving relation to said sucker rod string and a drive rope connected in driving relation to said sealed drive rod, a pump driving unit comprising:

a rotatably mounted sheave adapted to be positioned proximate said wellhead and to engage said drive rope to change the vertical drive direction of said drive rope to a horizontal drive direction;

a hydraulic cylinder including an in/out fluid line and a cylinder rod having a preselected length to provide a preselected maximum stroke length;

structural means mounting said hydraulic cylinder in a horizontal orientation with the axis of said cylinder in the plane of said sheave;

coupling means for coupling said cylinder rod to said drive rope in a pulling relation; and a hydraulic drive/control means for operating said hydraulic cylinder to provide a presettable operating cycle for said cylinder rod consisting of a hydraulic power upstroke and a gravity power downstroke of length presettable up to said maximum stroke length;

said structural means comprising an elongated horizontally disposed draw works having a foot end structure adapted to be placed proximate said wellhead and to support said rotatably mounted sheave, a head end structure adapted to mount said hydraulic cylinder and a body structure defining a horizontally disposed carriage channel having a length greater than said maximum operating stroke length; and said coupling means comprises a carriage assembly adapted to traverse said carriage channel, a second sheave of diameter substantially identical to said first sheave and rotatably mounted on said carriage assembly in a plane substantially coincident with the plane of the first sheave and adapted to engage said drive rope to reverse the direction of said drive rope by 180 degrees, a rope termination assembly mounted on said draw works for terminating said drive rope at a position proximate said first sheave, and a coupler assembly for coupling said carriage assembly to said cylinder rod.

2. Apparatus as claimed in claim 1, wherein said hydraulic drive/control system includes a hydraulic generator having power and return lines; a fluid control valve coupled to said in/out fluid line, said power line, and said return line and including a valve element and a valve element driving arrangement comprising a pair of solenoids individually actuatable to switch said valve element between first and second positions and spring means biasing said valve element into a third position when said solenoids are both deactuated, said first valve element position establishing a connection between said power line and said in/out line to drive said cylinder rod during said upstroke, said second valve element position establishing separate connections between said return line and each of said power line and said in/out line during said downstroke, said third valve element position establishing a connection between said power line and said return line and blocking said in/out line; a presettable flow restrictor and a check valve coupled in parallel between said fluid control valve and said in/out line for controlling the rate of fluid transfer out of said cylinder during said downstroke; and control means coupled to said valve driving arrangement for operating individual ones of said solenoids during presettable first and second time intervals to produce a presettable operating cycle for said fluid control valve.

3. Apparatus as claimed in claim 2, wherein said control means comprises first and second switch means, mounting means for mounting each of said switch means in a presettable position on said draw works, and switch actuator means mounted on said coupling means for actuating said switch means when said coupling means arrives at the location of said switch means, and switching circuit means operative in response to output signals from said first and second switch means, respectively, to actuate an associated one of said solenoids in said valve element driving arrangement and to deactuate the other of said solenoids to drive said valve element between said first and second positions.

4. Apparatus as claimed in claim 3, further comprising a release valve coupled between said in/out line and said return line, and maintained in a normally closed position by a third solenoid commonly connected with said first and second switch means and said switching circuit means to an electric power source to enable a downstroke of said cylinder rod upon failure of said electric power source and consequent deactuation of all of said solenoids.

5. Apparatus as claimed in claim 4, further comprising a time delay circuit arrangement coupled between said third solenoid and said source of electric power to preclude reapplication of power to said third solenoid for a time interval sufficient to complette the downstroke of said cylinder rod.

6. Apparatus as claimed in any of claims 3, 4, and 5, wherein said switching circuit means includes first and second relay means operable in response to signals from associated first and second switch means; and further comprising a time delay circuit arrangement coupled between one of said first and second switching means associated with the end of the cylinder rod downstroke and an associated one of said first and second relay means to delay the start of the hydraulic power upstroke after completion of the gravity power downstroke.

* * * * *